US011396749B2

(12) United States Patent
Smith et al.

(10) Patent No.: US 11,396,749 B2
(45) Date of Patent: Jul. 26, 2022

(54) EXTERIOR WALL SYSTEM

(71) Applicant: MITEK HOLDINGS, INC., Wilmington, DE (US)

(72) Inventors: Kirt Smith, Portland, OR (US); Chad Walswick, Lemon Grove, CA (US); John Frank, Rowlett, TX (US); Jeff Heymann, Portland, OR (US); Alex Wilson, Milwaukie, OR (US); Ryan Raschke, San Diego, CA (US)

(73) Assignee: MITEK HOLDINGS, INC., Wilmington, DE (US)

( * ) Notice: Subject to any disclaimer, the term of this patent is extended or adjusted under 35 U.S.C. 154(b) by 0 days.

(21) Appl. No.: 17/068,888

(22) Filed: Oct. 13, 2020

(65) Prior Publication Data

US 2021/0222431 A1 Jul. 22, 2021

Related U.S. Application Data

(60) Provisional application No. 63/010,338, filed on Apr. 15, 2020, provisional application No. 62/963,976, filed on Jan. 21, 2020.

(51) Int. Cl.
*E04B 2/92* (2006.01)
*E04B 1/20* (2006.01)

(52) U.S. Cl.
CPC . *E04B 2/92* (2013.01); *E04B 1/20* (2013.01)

(58) Field of Classification Search
CPC ..... E04C 2002/001; E04C 2002/005; E04C 2/02; E04C 2/44; E04C 2/46; E04C 2/48;
(Continued)

(56) References Cited

U.S. PATENT DOCUMENTS 2,104,869 A * 1/1938 Levy ..... E04B 2/62 52/274
3,176,432 A * 4/1965 Doolittle, Jr. ..... E04H 5/10 52/293.3

(Continued)

FOREIGN PATENT DOCUMENTS

CN 202227551 U * 5/2012
CN 202227551 U 5/2012

(Continued)

OTHER PUBLICATIONS

Translation of CN202227551.*

(Continued)

*Primary Examiner* — Jessica L Laux
(74) *Attorney, Agent, or Firm* — Stinson LLP

(57) ABSTRACT

An exterior wall section forms a portion of an exterior wall of a building. The building has multiple floors and a framework defining the multiple floors. The exterior wall section includes a structural layer to be connected to the framework. The structural layer includes a plurality of studs connected together. An insulation layer is supported by the structural layer to insulate the building. Siding is supported by the structural layer and defines an exterior side of the exterior wall section. A perimeter of the exterior wall section is defined by the edge margins of the structural layer, the insulation layer and/or the siding. The exterior wall section includes an interlocking structure extending along the perimeter that mates with an interlocking structure of another exterior wall section to form a seal with said another exterior wall section when the exterior wall sections are connected to the building.

30 Claims, 7 Drawing Sheets

(58) Field of Classification Search
CPC ... E04C 2/50; E04C 2/526; E04B 2/56; E04B 2/562; E04B 2/58; E04B 2/60; E04B 2/62; E04B 2/70; E04B 2/701; E04B 2/702; E04B 2/90; E04B 2/92; E04B 2/965; E04B 2/967; E04B 2/88; E04B 2/885
See application file for complete search history.

(56) References Cited

U.S. PATENT DOCUMENTS 3,504,465 A * 4/1970 Brinker ..... E04B 2/962 52/282.3
3,638,370 A * 2/1972 Miller ..... A47B 96/1416 52/36.6
4,021,987 A * 5/1977 Schnebel ..... E04B 2/96 52/764
4,597,237 A 7/1986 Celli
4,599,838 A * 7/1986 Kaminaga ..... E04B 2/90 52/204.591
4,685,263 A 8/1987 Ting
4,866,896 A 9/1989 Shreiner et al.
5,105,593 A * 4/1992 Kaminaga ..... E04B 2/90 52/204.591
5,127,202 A * 7/1992 Yokota ..... E04B 2/90 52/235
5,297,369 A * 3/1994 Dickinson ..... E04B 2/7411 52/145
5,916,100 A 6/1999 Mitchell et al.
5,953,883 A * 9/1999 Ojala ..... E04B 1/26 52/794.1
6,226,947 B1 * 5/2001 Bado ..... E04F 19/06 52/483.1
6,253,511 B1 7/2001 Boyer
6,571,523 B2 * 6/2003 Chambers ..... E04B 1/14 52/270
7,644,549 B2 1/2010 Speck
7,735,282 B2 * 6/2010 Price ..... E04B 1/10 52/408
7,748,181 B1 7/2010 Guinn
8,621,804 B2 * 1/2014 Houle ..... E04C 2/386 52/404.1
8,991,121 B1 * 3/2015 Baker ..... E04B 2/965 52/235
9,689,162 B2 * 6/2017 Cullen ..... E04F 13/141
9,752,319 B1 9/2017 LeVan
9,856,645 B2 * 1/2018 Dahlin ..... E04B 1/762
10,053,859 B2 8/2018 Evensen et al.
10,724,234 B2 7/2020 LeVan
2011/0258944 A1 * 10/2011 Radoane ..... E04B 1/665 52/62
2011/0296781 A1 * 12/2011 McCary ..... E04B 2/707 52/309.2
2014/0090323 A1 * 4/2014 Glancy ..... E04C 2/292 52/404.2
2014/0298740 A1 * 10/2014 Ting ..... B32B 17/10055 52/302.1
2015/0040504 A1 * 2/2015 Mei ..... E04B 1/26 52/309.13
2015/0052838 A1 * 2/2015 Ritchie ..... B32B 27/306 52/408
2017/0009442 A1 * 1/2017 Iverson ..... E04B 2/707
2019/0383003 A1 * 12/2019 Stahl, Jr. ..... E04B 2/7457

FOREIGN PATENT DOCUMENTS

CN 109736475 A * 5/2019
CN 109736475 A 5/2019
EP 0775786 A2 * 5/1997 ..... E04B 2/88
WO 2018073800 A1 4/2018

OTHER PUBLICATIONS

Translation of CN109736475.*
Architecture Design Handbook Architectural Details Wall Cladding Curtain Wall Systems, 5 pages.
Considerations For Re-Cladding Highrise Panelized EIFS Buildings—A Case Study, 11th Canadian Conference on Building Science and Technology Banff, Alberta 2007, 16 pages.
Curtain Walls WBDG Whole Building Design Guide, May 10, 2016, 19 pages.
Fenestration Systems WBDG Whole Building Design Guide, May 10, 2016, 3 pages.
Wall Systems WBDDG Whole Building Design Guide, May 10, 2016, 35 pages.
International Search Report and Written Opinion for PCT App. No. PCT/us2021/014117, dated Apr. 1, 2021, 42 pages.

* cited by examiner

EXTERIOR WALL SYSTEM

CROSS-REFERENCE TO RELATED APPLICATIONS

This application claims priority to U.S. Provisional Application No. 63/010,338, filed Apr. 15, 2020, and claims priority to U.S. Provisional Application No. 62/963,976, filed on Jan. 21, 2020, the entireties of which are hereby incorporated by reference.

FIELD OF THE DISCLOSURE

The present disclosure generally relates to an exterior wall of a building and, more particularly, to an exterior wall system formed from exterior wall sections.

BACKGROUND OF THE DISCLOSURE

The use of structural steel and reinforced concrete in construction has allowed for large high-rise buildings to be supported by a framework (e.g., a system of columns, beams, slabs, etc.) rather than exterior walls. This has led to the ability for buildings, particularly high rise buildings, to employ a variety of different exterior wall constructions. One such conventional exterior wall construction used in large buildings is a curtain wall. Curtain walls (e.g., modular or unitized curtain walls) typically comprise pre-fabricated rectangular units that are attached or hung from the framework of the building. These modular units of the curtain wall allow the exterior wall of the large building to be assembled relatively quickly. Curtain walls typically include a large amount of glazing (e.g., windows) supported by mullions which are connected to the framework of the building. As such, curtain walls are not load-bearing—i.e., do not carry any of the floor or roof loads of a building. Other types of conventional exterior constructions are cavity exterior walls, barrier exterior walls, or mass exterior walls. Typically, these exterior walls (e.g., load or semi-load bearing exterior walls) includes structural components (e.g., studs) that extend between the floors (e.g., slabs, beams) of a building and a veneer attached to the structural components defining the exterior of the building. Typical veneers include bricks or aluminum panels.

SUMMARY OF THE DISCLOSURE

In one aspect, an exterior wall section that forms a portion of an exterior wall of a building, the building having multiple floors and a framework defining the multiple floors, comprises a structural layer configured to be connected to the framework of the building and to support a weight of the exterior wall section. The structural layer includes a plurality of studs connected together. An insulation layer is supported by the structural layer and includes insulation configured to insulate the building from an outside environment. Siding is supported by the structural layer and is disposed to the exterior of the structural layer and insulation layer. The siding defines an exterior side of the exterior wall section. A perimeter is defined by edge margins of at least one of the structural layer, the insulation layer or the siding. An interlocking structure extends along the perimeter and is configured to mate with an interlocking structure of at least one other exterior wall section to form a seal with said at least one other exterior wall section when the exterior wall sections are connected to the framework of the building.

In another aspect, an exterior wall section forming a portion of an exterior wall of a building having a framework comprises a structural frame made of cold formed steel components including studs extending between a sill and a top plate. The structural frame has a perimeter extending along the length of the top plate, along the length of one of the studs at one end of the structural frame, along the length of the sill and along the length of another one of the studs at an opposite end of the structural frame. An extruded metal border extends around the perimeter of the structural frame and is connected to and supported by the structural frame. The extruded metal border is configured to sealingly mate with other exterior wall sections to form a water and air barrier.

Other objects and features of the present disclosure will be in part apparent and in part pointed out herein.

BRIEF DESCRIPTION OF THE DRAWINGS

Corresponding reference characters indicated corresponding parts throughout the drawings.

DETAILED DESCRIPTION OF THE DISCLOSURE

Figure 1:
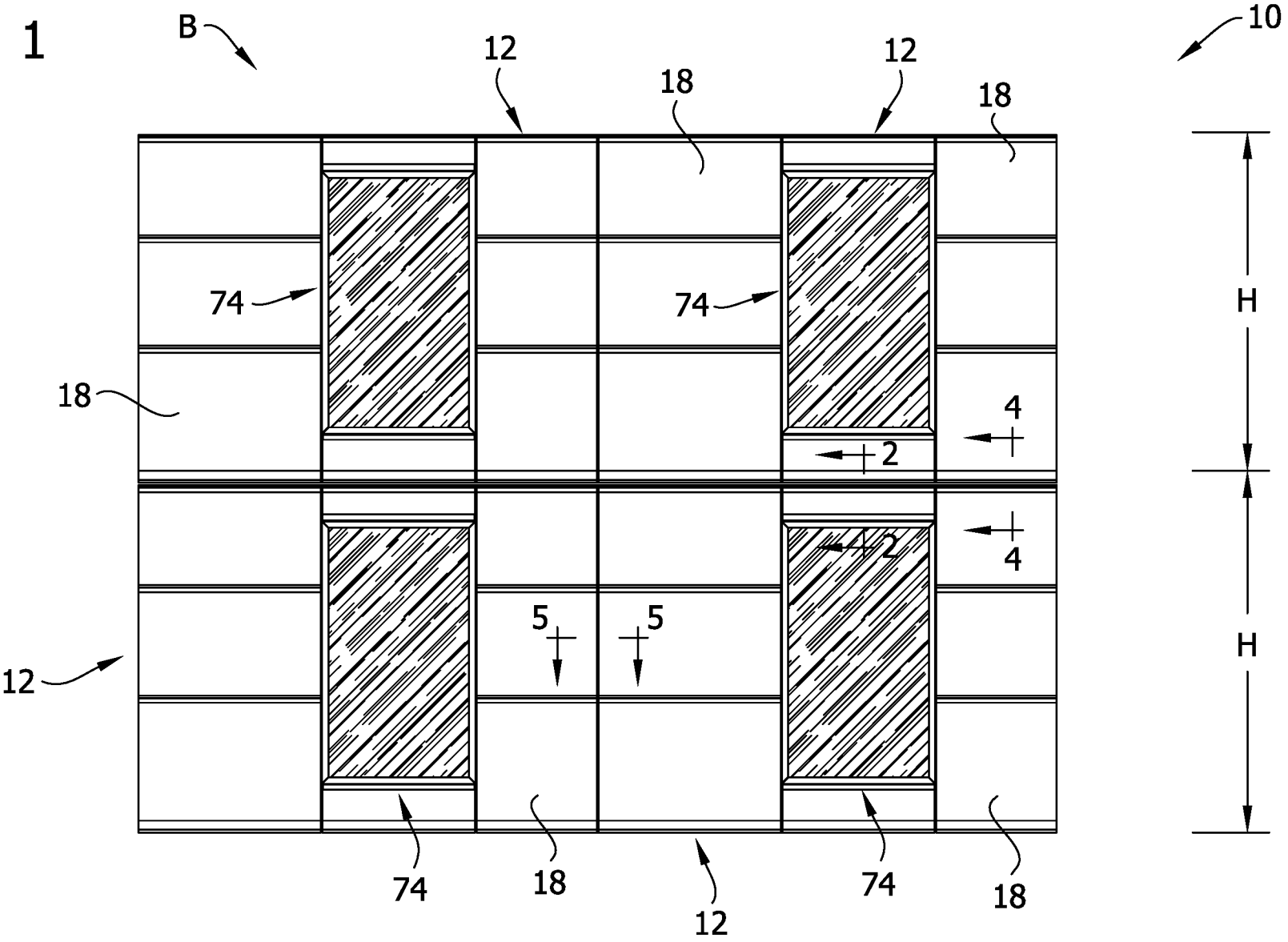
FIG. 1 is a front view of a portion of an exterior wall system comprising a plurality of exterior wall sections attached to a framework of a building according to one embodiment of the present disclosure.

Referring to FIG. 1, one embodiment of an assembled exterior wall system constructed according to the teachings of the present disclosure is indicated generally at reference numeral 10. The exterior wall system 10 is mounted on the framework F (FIG. 2) of a building B. The framework F of the building B may include a system of columns (concrete or steel), beams (steel), slabs (concrete), mass timber, etc. that forms the structure of the building and defines the multiple floors of a building. The exterior wall system 10 includes a plurality of exterior wall units or sections 12. The exterior wall sections 12 are configured to be attached to the framework F of the building B to form the exterior wall of the building. Four exterior wall sections 12 are illustrated in FIG. 1 as mounted on the framework F of building B. The exterior wall sections 12 are generally rectangular modular units configured to be placed in a grid arrangement (e.g., columns and rows) to create the exterior wall of the building B. Other shapes of the exterior wall sections 12 are within the scope of the present disclosure. In one method of construction, the exterior wall sections are pre-fabricated off-site and brought to the construction site, where they are attached to the framework F of the building B. This manner of construction greatly reduces the cost and time required to assemble the exterior wall of the building B. For purposes of clarity, the following description refers to one of the exterior wall sections 12, with the understanding that the teachings apply equally to the other exterior wall sections.

Figure 7:
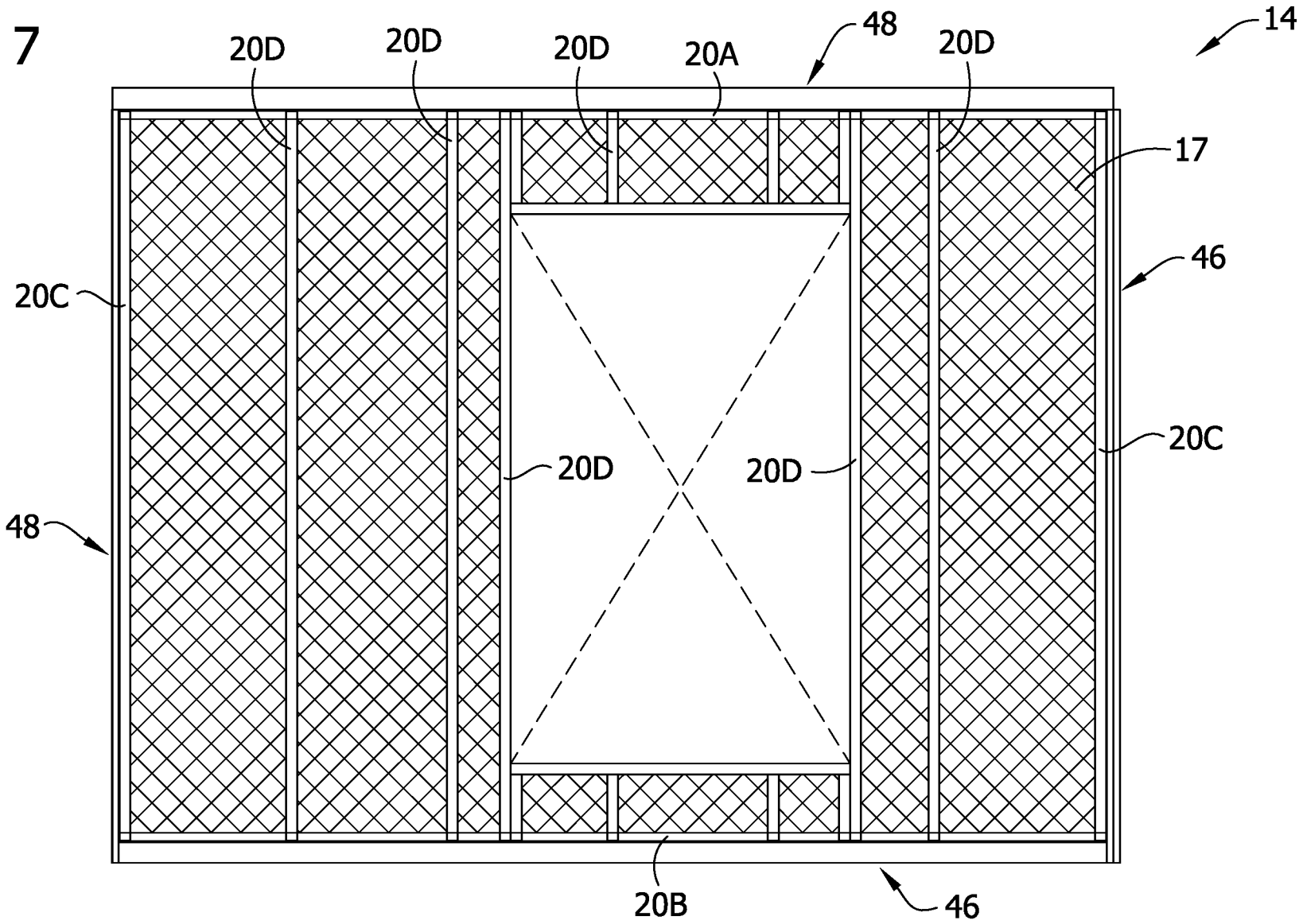
FIG. 7 is an elevation of a structural layer of an exterior wall section of the exterior wall system.

Referring to FIGS. 2-7, the exterior wall section 12 includes a structural layer 14, an insulation layer 16 and siding 18 (e.g., a siding layer). The structural layer 14 is configured to be connected to the framework F of the building B. The structural layer 14 is also configured to support the weight of the exterior wall section 12. The structural layer 14 includes a plurality of structural components 20 (e.g., studs) connected together. The structural components 20 support the entire weight of the exterior wall section 12 and enable the exterior wall section to be attached to the framework F as a single integral unit, as described in more detail below. The structural components 20 include a generally horizontal header or top plate 20A, a generally horizontal sill 20B, generally vertical opposite side studs 20C, and a plurality of (broadly, at least one) generally vertical intermediate studs 20D (FIG. 7). The side studs 20C and intermediate studs 20D extend between and interconnect the top plate 20A and sill 20B. The top plate 20A, sill, 20B, and opposite side studs 20C define respective upper, lower and side edge margins of the structural layer 14. In one embodiment, the structural components 20 may include secondary side studs (not shown) attached, in a suitable manner such as by welding, to the opposite side studs 20C, respectively, to strengthen the sides of the structural layer 14, such as by forming a box column. In the illustrated embodiment, the structural components 20 are cold formed steel components having a generally C-shape cross-section. Other configurations are within the scope of the present disclosure. For example, the structural components 20 can be made of wood. The structural layer 14 has an exterior surface or face and an interior surface or face (defined by the structural components 20). When the structural layer 14 is attached to the framework F of the building B, the interior surface faces the interior of the building B and the exterior surface faces away from the interior of the building.

The structural layer 14 is mounted on the framework F with a mounting assembly 22. The mounting assembly 22 carries the dead load of the exterior wall section 12. In the illustrated embodiment, the mounting assembly 22 includes a drift clip 23. The drift clip 23 is secured to one structural component 20 (generally, a stud such as the intermediate studs 20D) with one or more fasteners 24 (e.g., bolts, screws, etc.). Instead of or in addition to the fasteners 24, the drift clip 23 may be welded to a structural component 20 as well. The mounting assembly 22 is mounted on the framework F. In the illustrated embodiment, the mounting assembly 22 includes a generally horizontal track 26 embedded in or anchored to a concrete slab of the framework F and an adjustment bracket system 25 coupled to the track and the drift clip 23. The mounting assembly is configured to move the exterior wall section 12 in the x-axis, y-axis and z-axis directions to account for variances in construction (e.g., variances in the framework F). The adjustment bracket system 25 may move along the track 12 to allow the exterior wall sections 12 to move horizontally (e.g., in an x-axis direction) relative to the framework F to permit lateral movement between the exterior wall sections and the framework. The adjustment bracket system 25 is also configured to move the drift clip 23 vertically (e.g., in a y-axis direction) relative to the framework F and to move the drift clip outward from the framework or inward toward the framework (e.g., in a z-axis direction). This movement allows the exterior wall section 12 to be aligned and plumb with the other exterior wall sections. In the illustrated embodiment, the drift clips 23 are connected to the intermediate structural component 20D adjacent to the top plate 20A, although other positions are within the scope of the present disclosure. In this manner, the exterior wall section 12 generally hangs from the mounting assembly 22 when connected to the building B. Any number of mounting assemblies 22 can be used to connect the structural layer 14 to the framework F. Other configurations of the mounting assembly 22 are within the scope of the present disclosure. For example, instead of drift clips 23, the exterior wall sections 12 can be connected to the framework F with anchor plates. The mounting assembly 22 may be surrounded with fireproofing, such as mineral wool (e.g., compression fit mineral wool), for fire rating purposes. For example, in one embodiment, the exterior wall section 12 may have a 2-hour fire rating. For example, the 2-hour fire rating at the floor may be achieved by installing a fire resistant material, such as mineral wool, between the edge of the framework F (e.g., the floor slab) and the back of the exterior wall section 12. A smoke sealant may be adhered to the fire resistant material between the edge of the framework F and the exterior wall section 12 to inhibit the flow of smoke between floors. The exterior wall section 12 may also be made up of materials that are non-combustible and provide fire resistance, as described in more detail herein.

As shown in the figures, the exterior wall section 12 is disposed on the exterior (e.g., in front) of the framework F when the exterior wall section is secured to the framework with the mounting assembly 22. The exterior wall section 12 has a height H (FIG. 1) that is greater than a height of one floor of the building B. The height of one floor is the distance between the upper surface of one floor slab and the lower surface of another floor slab (e.g., does not include the thickness of the floor slab). Accordingly, the exterior wall sections 12 do not extend between the floor slabs of the building B. Instead, the exterior wall sections 12 are mounted outside the framework F so that the exterior wall sections can mate with one another to form a seal between the sections, as described in more detail below. Unlike conventional curtain wall systems hung from the framework of a building which typically include only mullions and glazing, the exterior wall section 12 is a complete wall section including a structural layer 14, an insulation layer 16 and siding 18 (e.g., a siding layer) along with other features (described below) not presently found in curtain wall systems hung from the framework of a building.

Figure 2:
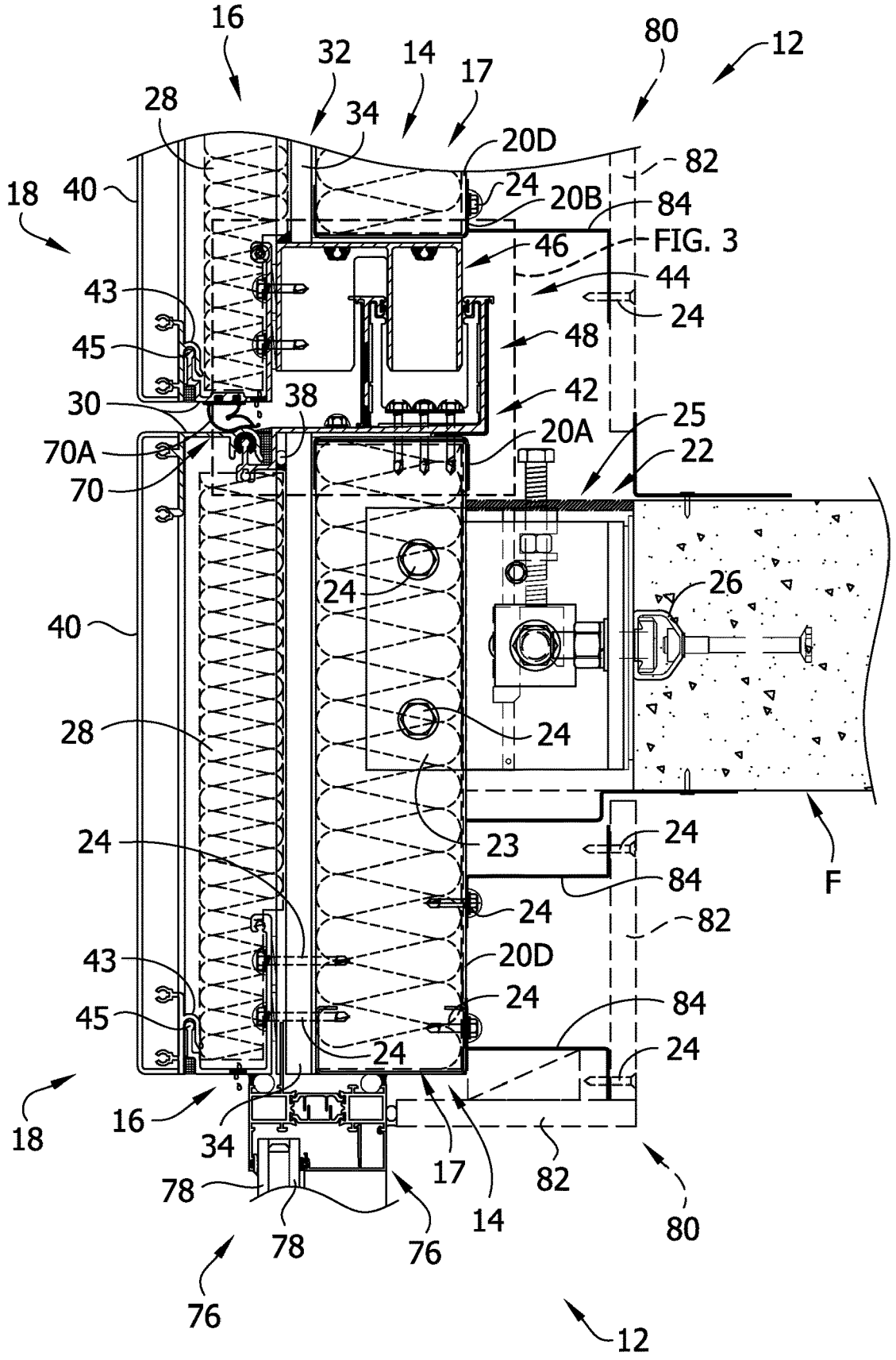
FIG. 2 is an enlarged, fragmentary cross-section of the exterior wall system taken in the plane including line 2-2 of FIG. 1.
Figure 3:
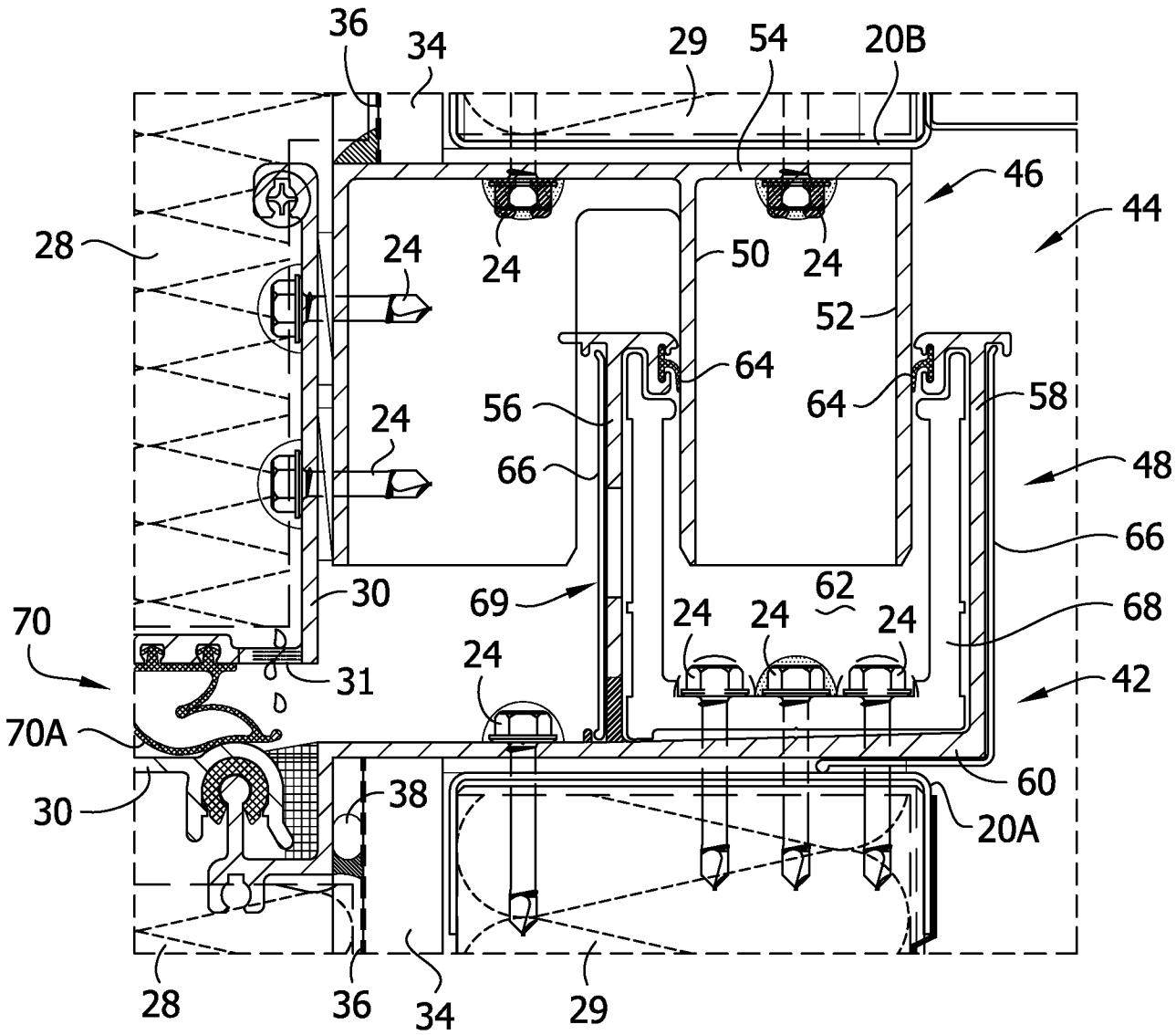
FIG. 3 is a further enlarged portion of FIG. 2.
Figure 4:
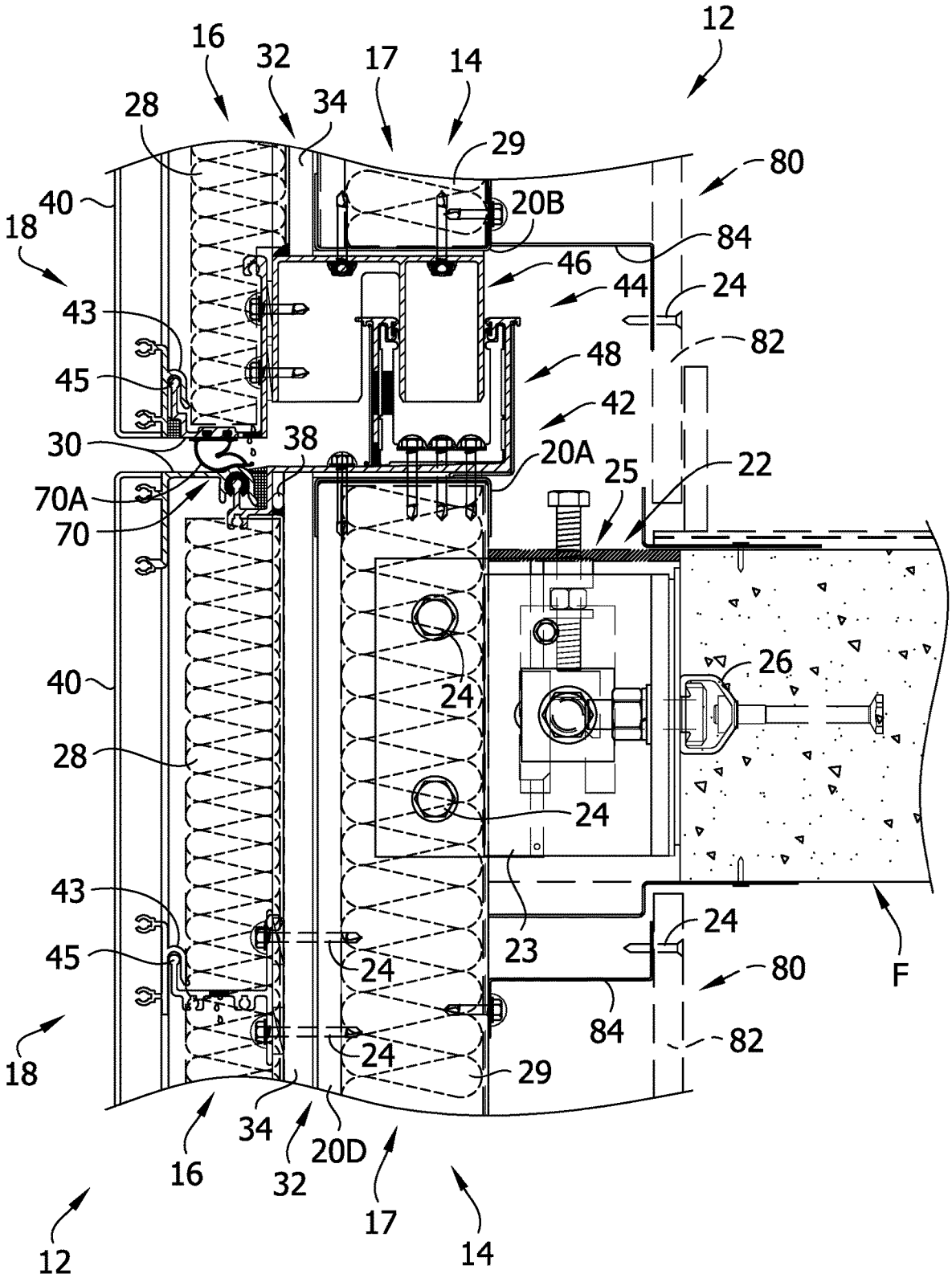
FIG. 4 is an enlarged, fragmentary cross-section of the exterior wall system taken in the plane including line 4-4 of FIG. 1.

The insulation layer 16 (e.g., a first or primary insulation layer) is supported by the structural layer 14. The insulation layer 16 is on the exterior side of the structural layer 14. The insulation layer 16 includes insulation 28 to insulate the building B from the outside environment. In one embodiment, the insulation 28 may have a thickness of about 2 inches. The insulation 28 can be any type of suitable insulation such as mineral wool, fiberglass, cellulose, foam, batt, or blow-in, or any other suitable rigid insulation that meets code values for flame spread and propagation. In the illustrated embodiment, the insulation layer 16 includes an insulation housing 30 defining an interior or space that is filled with the insulation 28. In one embodiment, the insulation housing 30 is made from sheet metal, although other suitable materials are within the scope of the present disclosure. In the illustrated embodiment, the housing 30 comprises multiple pieces that are attached to each other or other components of the exterior wall section 12. Some pieces of the housing 30 may be connected together using a clip and catch, as described below. The housing 30 may not fully enclose the insulation 28. In the illustrated embodiment, the housing 30 is partially filled with insulation 28 such that an air gap is disposed outward of the insulation (between the siding 18 and the insulation). This air gap provided additional insulation for the exterior wall section 12. The housing 30 may also include weep holes 31 (FIG. 3) along the lower end thereof to allow any moisture which gets past the siding 18 and into the housing to drain. The insulation layer 16, specifically, the insulation housing 30, may be connected to the structural layer 14 by fasteners 24, clips, or any other suitable method. The insulation layer 16 may extend past the structural layer 14. Specifically, the one or more of the edge margins of the insulation layer 16 may be disposed outward of the corresponding edge margins of the structural layer. For example, as shown in FIGS. 2-6, the lower and side edge margins of the insulation layer 16 are disposed outward of the respective lower and side edge margins of the structural layer 14. The edge margins of the insulation layer 16 can also be flush or co-planar with the edge margins of the structural layer 14. For example, as shown in FIGS. 2 and 4, the upper edge margins of the insulation and structural layers 12, 16 are generally flush with one another.

The exterior wall section 12 may also include a second insulation layer 17 (e.g., a secondary insulation layer) supported by the structural layer 14. In the illustrated embodiment, the second insulation layer 17 is coextensive with the structural layer 14. The second insulation layer 17 includes insulation 29. Preferably, the insulation 29 is about the same thickness as the insulation layer. The insulation 29 is generally packed or otherwise disposed in the spaces between the structural components 20.

In the illustrated embodiment, the exterior wall section 12 includes a sheathing layer 32. The sheathing layer 32 is disposed between the insulation layer 16 and the structural layer 14. Specifically, in the illustrated embodiment, the sheathing layer 32 is mounted directly to the exterior surface of the structural layer 14. The sheathing layer 32 includes one or more sheets of sheathing 34. In one embodiment, the sheathing layer 32 (e.g., the sheathing 34) has a thickness of about ⅝ inch. The sheathing layer 32 defines a continuous, planar exterior surface on which a moisture barrier 36 (FIG. 3) can be mounted. The moisture barrier 36 may be configured to inhibit the passage of water there-through while allowing moisture vapor to pass there-through or the moisture barrier may be configured to inhibit both the passage of water and vapor there-through. In the illustrated embodiment, the insulation layer 16 is directly mounted on the exterior surface or face of the moisture barrier 36. The moisture barrier 36 may be a spray on material or a generally thin sheet of material. The sheathing 34 may be made from a fire resistant material to provide fire resistance. For example, the sheathing 34 may be made from a magnesium oxide based material, although other suitable materials are within the scope of the present disclosure.

The siding 18 is supported by the structural layer 14. The siding 18 is disposed exteriorly of both the structural layer 14 and the insulation layer 16. The siding 18 defines the exterior side of the exterior wall section 12. The siding 18 is configured to protect the exterior wall section 12 (and its components) and the building B from the elements such as the sun, rain, snow, temperature, wind, etc. In the illustrated embodiment, the siding 18 comprises a plurality of panels 40. Any number of panels 40 can be used. The panels 40 may be made from any suitable material such as metal (e.g., aluminum), plastic, stone, etc. Other types of siding 18 such as masonry, wood, vinyl, etc. are also within the scope of the present disclosure. The siding 18 is mounted on the exterior of (e.g., the exterior surface or face of) the insulation layer 16. Each panel 40 may include at least one attachment mechanism 43 to connect the siding 18 to the insulation layer 16. In the illustrated embodiment, the attachment mechanism 43 is a clip configured to attach to a catch 45 of the insulation housing 30. The panels 40 may also be connected to the insulation housing 30 with fasteners 24 (e.g., a bolt, screw, etc.). Other configurations of the attachment mechanism are within the scope of the present disclosure. For example, the attachment mechanism 43 may be an L-shaped hook (not shown) configured to extend through a corresponding slot (not shown) in the housing 30 of the insulation layer 16 to connect the panel 40 to the insulation layer. In one embodiment, the siding 18 may include a back support (not shown) that generally interconnects the panel 40 a portion of the housing 30 of the insulation layer 16, thereby facilitating attachment of the panel to the insulation layer. In the illustrated embodiment, the edge margins of the siding 18 are flush or co-planar with the edge margins of the insulation layer 16, as shown in FIGS. 2-6. Other manners of attaching the siding 18 to the rest of the exterior wall section 12 are within the scope of the present disclosure.

Figure 5:
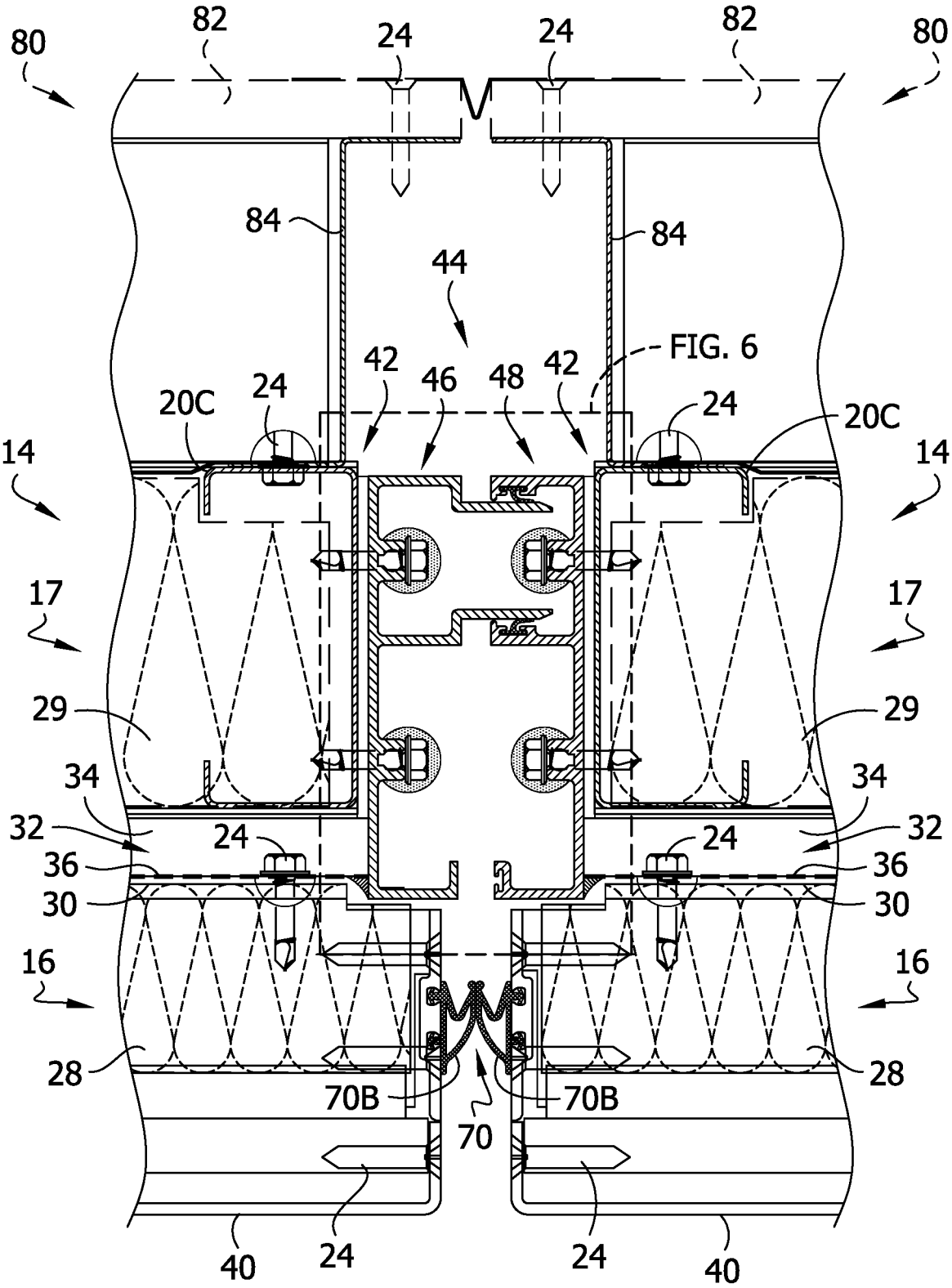
FIG. 5 is an enlarged, fragmentary cross-section of the exterior wall system taken in the plane including line 5-5 of FIG. 1.
Figure 6:
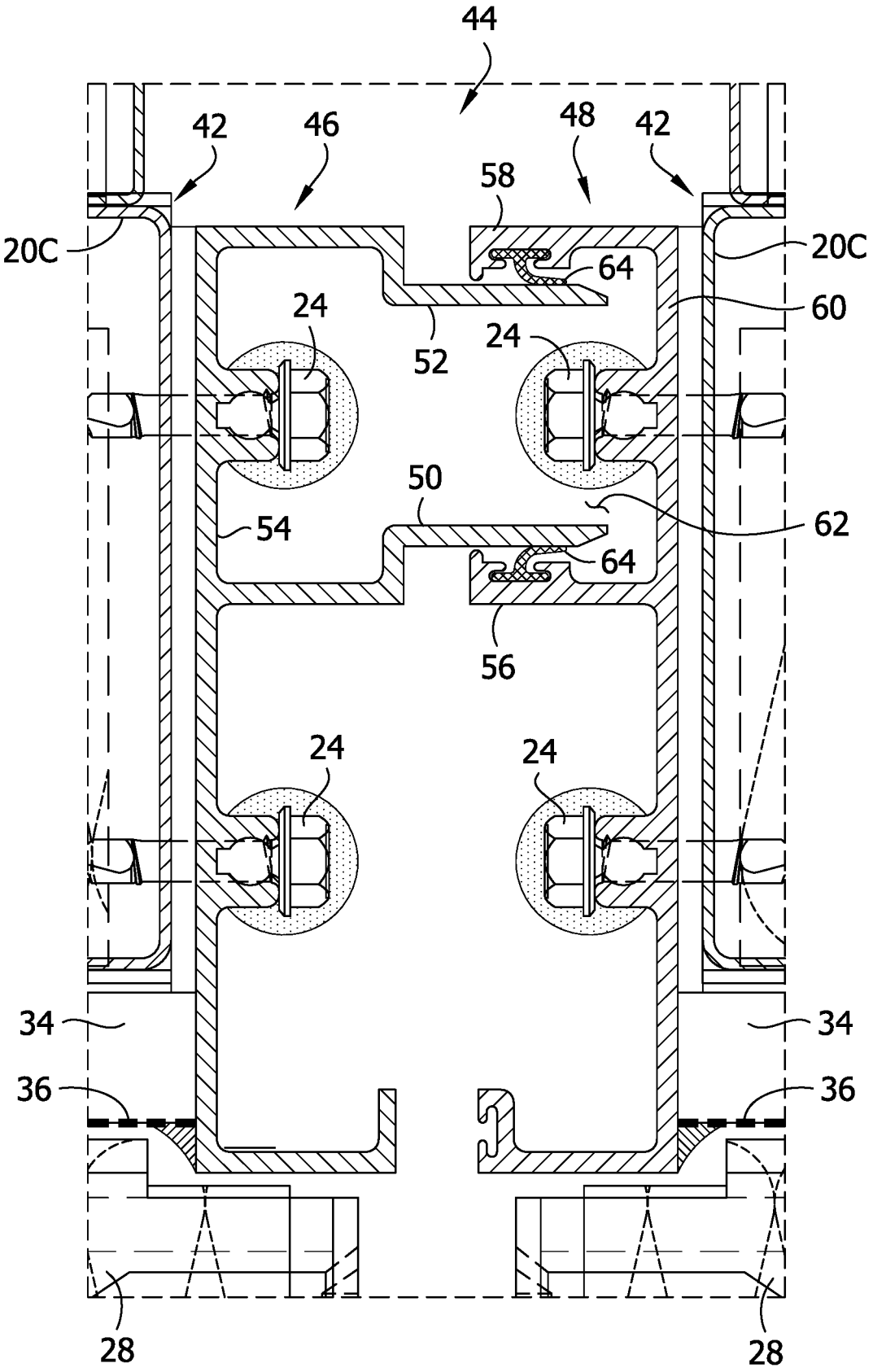
FIG. 6 is a further enlarged portion of FIG. 5

In one embodiment, to limit the egress of moisture between adjacent exterior wall sections, the lower end of the insulation housing 30 may include a lower wall (not shown) extending downward from the housing and the upper end of the housing may include an upper wall (not shown) extending upward from the housing. The lower wall of one exterior wall section 12 overlies the upper wall of another exterior wall section to reduce or prevent fluid (e.g., water) from passing between the two wall sections. In one embodiment, an additional section of insulation (not shown) may be disposed behind the upper wall to insulate any space between the lower and upper ends of the two wall sections. Alternatively or in addition to, the edges (e.g., sides) of the exterior wall sections 12 (specifically, the housings 30) may abut or be positioned in close conformance with (e.g., right next to) each other to limit the egress of water, as shown in FIG. 5.

The exterior wall section 12 may also include an interior finish layer 80 supported by the structural layer 14. The interior finish layer 80 defines the interior surface of the exterior wall section 12 visible to the occupants of the building B. The interior finish layer 80 includes interior sheathing 82, such as drywall (which also provided fire resistance), defining the interior surface and mounting brackets or channels 84. The mounting brackets 84 are attached to the structural layer 14 and space the interior sheathing 82 interiorly from the structural layer. Fasteners 24 may be used to attach the mounting brackets 84 to the structural layer 14. Other manners of attaching the mounting brackets 84 to the structural layer 14, such as by welding, are within the scope of the present disclosure. The space between the interior sheathing 82 and the structural layer 14 enables electrical conduit, pipes, etc. to be housed therein as needed. In one embodiment, the interior sheathing 82 may be attached to the mounting brackets 84, such as with fasteners 24 (e.g., drywall screws or nails), after the exterior wall section 12 is attached to the framework F of the building B. The final nature of the interior finish applied to the interior finish layer 80 such as paint, baseboards, etc. will typically be applied after the exterior wall section 12 is attached to the framework F.

The exterior wall section 12 has a perimeter 42. The perimeter 42 is defined by the edge margins of at least one of the structural layer 14, the insulation layer 16 and/or the siding 18. Other layers may also define the perimeter. For example, in the illustrated embodiments, the peripheral edge margins of each of the structural layer 14, the insulation layer 16, the siding 18, sheathing layer 32 and moisture barrier 36 define the perimeter 42 of the exterior wall section 12.

Referring to FIGS. 2-6, the exterior wall section 12 includes interlocking structure 44 extending along the perimeter 42. As will become apparent, the interlocking structure 44 of one exterior wall section 12 forms a seal (e.g., a fluid and/or moisture/vapor tight seal) with the interlocking structure of adjacent exterior wall sections (broadly, at least one other exterior wall section) when the exterior wall sections are connected to the framework F of the building B. In general, and explained in more detail below, the interlocking structure 44 of one exterior wall section 12 can be mated with the interlocking structure of other exterior wall sections to form the seal between the exterior wall sections. In one embodiment, the interlocking structure 44 extends along a majority of the entire perimeter 42 of the exterior wall section 12. Preferably, the interlocking structure 44 extends along generally the entire perimeter 42, and, even more preferably, along the entire perimeter (e.g., the interlocking structure extends substantially continuously along the perimeter). In the illustrated embodiment, the interlocking structure 44 is secured to the structural layer 14, although other configurations are within the scope of the present disclosure. As shown in FIGS. 2-6, the interlocking structure 44 extends outward from the perimeter 42 of the exterior wall section 12. Specifically, the interlocking structure 44 extends outward from the edge margins of the structural layer 14.

In one embodiment, the interlocking structure 44 comprises a first interlocking connector 46 and a second interlocking connector 48. The first interlocking connector 46 of one exterior wall section 12 forms a seal with the second interlocking connector 48 of adjacent exterior wall sections to form a seal between the exterior wall sections when connected to the framework F of the building B (e.g., the first interlocking connector is mateable with the second interlocking connector). Likewise, the second interlocking connector 48 of one exterior wall section 12 forms a seal with the first interlocking connector 46 of adjacent exterior wall sections to form a seal between the exterior wall sections when connected to the framework F of the building B to prevent the egress of liquid into the interior of the structural layer 14.

The interlocking structure 44 for one exterior wall section 12 can include both the first and second interlocking connectors 46, 48. For example, the first and second interlocking connectors 46, 48 for the interlocking structure 44 of one exterior wall section 12 can extend along different portions of the perimeter 42. For example, in the illustrated embodiment, the first interlocking connector 46 extends along the lower and right side portions of the perimeter 42 and the second interlocking connector 48 extends along the upper and left side portions of the perimeter. This way, when one exterior wall section 12 is attached to the framework F, the first interlocking connector 46 extending along the lower side portion of the perimeter 42 for the one exterior wall section mates with a second interlocking connector 48 extending along the upper side portion of the perimeter of another exterior wall section below the one exterior wall section. The first interlocking connector 46 extending along the left side portion of the perimeter of the one exterior wall section 12 mates with the second interlocking connector 48 on the right side of another exterior wall section to the left of the one exterior wall section. Similarly, the second interlocking connector 48 on top of the one exterior wall section 12 can be mated with the first interlocking connector 46 on the bottom of still another exterior wall section located above the one exterior wall section, and the second interlocking connector on the right side of the one exterior wall section can be mated with the first interlocking connector of yet another exterior wall section located to the right of the one exterior wall section. In other embodiments, the interlocking structure 44 of one exterior wall section 12 may only include the first interlocking connector 46 and the interlocking structure of another exterior wall section may only include the second interlocking connector 48. In this embodiment, the first interlocking connector 46 of one exterior wall section 12 will mate with the second interlocking connectors 48 of the adjacent exterior wall sections. Accordingly, in general the interlocking structure 44 includes four interlocking connector components (e.g., two first interlocking connectors 46 and two second interlocking connectors 48 or four first interlocking connectors or four second interlocking connectors or any combination thereof), each one on a side (e.g., portion or segment of the perimeter 42) of the exterior wall section 12 and extending substantially continuously along the length of the corresponding side. The interlocking structure 44 may be made of a suitable material, such as extruded aluminum.

In the illustrated embodiment, the first interlocking connector 46 is a male interlocking connector and the second interlocking connector 48 is a female interlocking connector. The male interlocking connector 46 is inserted into a female interlocking connector 48 (of another exterior wall section 12) and the female interlocking connector receives a male interlocking connector 46 (of another exterior wall section) to form the seal between the exterior wall sections. It is noted that the seal is achieved simply by the interconnection of adjacent wall sections 12. No caulking or application of other material to the wall sections 12 is required for sealing.

The male interlocking connector 46 includes opposing first and second walls or arms 50 and 52, respectively (broadly, at least one arm). The first and second arms 50, 52 extend outward from a connector base 54 of the male interlocking connector 46. The connector base 54 is secured to the perimeter 42 of the exterior wall section 12. As explained in more detail below, the first arm 50 engages the female interlocking connector 48 of another (broadly, at least one other) exterior wall section 12 to form a portion (broadly, at least a portion) of the seal between the exterior wall sections (e.g., between the interlocking structures 44). Likewise, the second arm 52 engages the female interlocking connector 48 of another (broadly, at least one other) exterior wall section 12 to form a portion (broadly, at least a portion) of the seal between the exterior wall sections (e.g., between the interlocking structures 44).

The female interlocking connector 48 includes opposing first and second walls or arms 56 and 58, respectively (broadly, at least one arm). The first and second arms 56, 58 extend outward from a connector base 60 of the female interlocking connector 48. The connector base 60 is secured to the perimeter 42 of the exterior wall section 12. Accordingly, the illustrated female interlocking connector 48 has a generally channel shape defining a channel 62 sized and shaped to receive the male interlocking connector 46 to form the seal. Specifically, the channel 62 receives the first and second arms 50, 52 of the male interlocking connector 46. The channel 62 extends along the perimeter 42 of the exterior wall section 12. Likewise, the first and second arms 50, 52 of the male interlocking connector 46 and the first and second arms 56, 58 of the female interlocking connector 48 extend along the perimeter 42 of the adjacent exterior wall section 12.

The male and female interlocking connectors 46, 48 are preferably made from (e.g., comprise) a rigid material such as metal, plastic or any other suitable material. For example, in the illustrated embodiment, the male and female interlocking connectors 46, 48 comprise extruded aluminum members. Suitable fasteners, such as sheet metal screws 24, may be used to secure the male and female interlocking connectors 46, 48 to the structural layer 14 so that the interlocking connectors extend around the entire perimeter of the structural layer.

Preferably, the interlocking structure 44 includes at least one gasket 64 (broadly, a resiliently compressible, deflectable or deformable member) to facilitate the formation of the seal between exterior wall sections 12. In the illustrated embodiment, the interlocking structure 44 includes two gaskets 64. Specifically, the female interlocking connector 48 of the interlocking structure 44 includes the two gaskets 64. Each gasket 64 engages a respective one of the arms 50, 52 of the male interlocking connector 46 to form the seal between the male and female interlocking connectors 46, 48 (broadly, the seal between interlocking structures 44 of adjacent exterior wall sections 12). Each gasket 64 extends substantially continuously along the length of the female interlocking connector 48 (broadly, along the length of a corresponding portion or segment of the perimeter 42). Because the gaskets 64 may only be included on the female interlocking connector 48, the gaskets may only extend along a portion of the perimeter 42, not the entire perimeter. Accordingly, each gasket 64 may only extend along the one or more portions or segments of the perimeter 42 of the exterior wall section 12. In the illustrated embodiment, each gasket 64 has a base captured in a channel formed in an inwardly projecting lip at the free ends of the first and second arms 56, 58. Each gasket 64 has an engagement portion that projects into the channel 62 to be engaged by the male interlocking connector 46. In other embodiments, the gaskets 64 may be included on the male interlocking connector 46.

It is understood that in other embodiments, the interlocking structure 44 may include other types of structural components, other than gaskets, channels and/or arms, having other types of interlocking connectors (e.g., male or female interlocking connectors) configured to form a seal between exterior wall sections 12.

When the interlocking structures 44 of two exterior wall sections 12 are mated, the male interlocking connector 46 and the female interlocking connector 48 engage one another. The first and second arms 50, 52 of the male interlocking connector 46 extend into the channel 62 defined by the female interlocking connector 48. The first and second arms 50, 52 generally extend along and next to the first and second arms 56, 58, respectively, of the female interlocking connector 48. The first and second arms 50, 52 engage and resiliently deflect the gaskets 64 at the free or upper end of each arm 56, 58 of the female interlocking connector 48 to form the fluid and moisture tight seal between the exterior wall sections 12.

It is understood that the interlocking structure 44 can form seals with other components of the building B besides other exterior wall sections 12, such as roofs or foundations. In the illustrated embodiment, the building component includes a male and/or female interlocking connector 46, 48 (broadly, an interlocking structure) that the interlocking structure 44 of the exterior wall section 12 engages to form a seal between the building component and the exterior wall section.

The male and female interlocking connector 46, 48 can have slightly different configurations depending on if the connector is mounted on the top portion, bottom portion or side portions of the perimeter 42, see for example FIGS. 2-6. Still, each configuration of the male and female interlocking connectors 46, 48 have generally the same features, as described above. However, depending on the portion of the perimeter 42 the interlocking connectors 46, 48 are mounted on, the interlocking connectors may have some additional features. For example, the female interlocking connector 48 mounted on the top portion of the perimeter 42 may include splice plates 66 and a splice 68. The splice plates 66 cover the outer surfaces of the first and second arms 56, 58 located outside of surfaces of the first and second arms defining an internal volume. Each splice plate 66 is secured in place by opposite outer lips at each end of the first and second arms. The splice 68 is received in the channel 62 and extends along the first and second arms 56, 58 and the base 60. Accordingly, the splice 68 also has a generally channel shape. The same fasteners 24 used to secure the interlocking connectors 46, 48 to the structural layer 14 may also secure the splice 68 to the interlocking connector. The splice plates 66 and splice 68 do not extend along the entire length of the female interlocking connector 48, thus the splice plates and splice are not shown as being intersected by the section plane in FIGS. 2 and 3 (e.g., are not cross-hatched). The splice plates 66 and the splice 68 are generally positioned at the interface of the exterior wall sections 12 (e.g., an end of the female interlocking connector 48) to form a seal at the corners between the adjacent exterior wall sections. The splice plates 66 extend over the adjacent female interlocking connectors 48 of two horizontally adjacent exterior wall sections 12. Similarly, the splice 68 extends into the channels 62 of adjacent female interlocking connectors 48 of two horizontally adjacent exterior wall sections 12. Any remaining gaps at the corners between the adjacent exterior wall sections can then be filled with a sealant (not shown). This arrangement of splice plates 66, splice 68 and/or sealant can also be used to form a seal where the corners of four exterior wall sections 12 meet. The splice plates 66 and splice 68 can slide over or into the adjacent exterior wall section 12 once the exterior wall sections are installed on the framework F before being secured in place (e.g., with fasteners 24). In addition, the exterior wall section 12 can also include one or more lift openings 69 (FIG. 3) sized and shaped to receive a hook or hoist lug so that the exterior wall section can be raised into position on the framework F with a lifting device, such as a crane. In the illustrated embodiment, the one or more lift openings 69 are defined by the female interlocking connector 48 mounted on the top portion of the perimeter 42.

Still referring to FIGS. 2-6, the exterior wall section 12 may include a weather strip 70 (e.g., gasket) that extends along the perimeter 42 and is disposed exteriorly of the interlocking structure 44 (specifically, the arms 50, 52, 56, 58 of the interlocking connectors 46, 48). The weather strip 70 engages the perimeter 42 of another exterior wall section 12 (broadly, at least one other exterior wall section) and/or the weather strip of the other exterior wall section to inhibit or block a liquid from the outside environment (e.g., rain) from reaching the interlocking structure 44 when the exterior wall sections are connected to the framework F of the building B. The weather strip 70 may be mounted and connected to the insulation housing 30, although other mounting locations are within the scope of the present disclosure. The weather strip 70 may extend along only a portion of the perimeter 42. For example, in the illustrated embodiment, the weather strip 70 includes segments 70A-B extending along the bottom, left and right side portions of the perimeter 42. These weather strip segments 70A-B generally engage the top, right and left side portions, respectively, of adjacent exterior wall sections 12. Accordingly, it is apparent that when the exterior wall sections 12 are installed on the framework F, a combination of weather strips segments 70A-B is formed that generally extends along or over substantially the entire perimeter 42 of each exterior wall section. The weather strip segments 70A-B can take different forms depending on the portion of the perimeter 42 the weather strip extends along. For example, the weather strip segment 70A extending along the bottom portion of the perimeter 42 may be a generally flexible gasket, panel or flap of rubber. The weather strip segment 70A engages and is deflected by the insulation housing 30, in the illustrated embodiment. In one embodiment, the weather strip segment 70A may be an extruded silicone gasket. Similarly, the weather strip segment 70B extending along the left and right side portions of the perimeter 42 (see, FIG. 5) may be a generally compressible, extruded silicone gasket that is compressed by engagement with another weather strip segment 70B of an adjacent exterior wall section 12. As shown, the weather strip segments 70A, 70B are elongate, hollow tubes formed to deflect in a predetermined manner about a hinge. Other configurations of the weather strip 70 are within the scope of the present disclosure.

The exterior wall section 12 may include one or more seals or gaskets 38 disposed between adjacent layers, and more broadly components, to form a fluid tight seal and prevent the egress of water and moisture therebetween. For example as may be seen in FIG. 3, the exterior wall section 12 includes a seal 38 disposed between the insulation layer 16 and the moisture barrier 36 (broadly, the structural layer 14). It is also envisioned that the seal 38 could engaged another surface such the interlocking connectors 46, 48. The seal 38 engages the interior face of a downwardly depending portion of an extension of the female interlocking connector base 60 and the moisture barrier 36. The seal 38 forms a fluid and moisture tight seal with the moisture barrier 36 to prevent the ingress of water and moisture thereby. The seal 38 may extend along one or more side edge margins of the insulation layer 16. The use of seals 38 in other positions within the exterior wall section 12 is within the scope of the present disclosure.

Referring to FIGS. 1 and 2, the exterior walls section 12 may also include one or more windows 74. Each window 74 comprises a window frame 76 and one or more sheets of glazing 78 supported by the window frame. The window frame 76 is preferably secured to the structural layer 14. A weather sealant (e.g., a silicone weather sealant) and a backer rod (not shown) may be disposed between the window frame 76 and the structural layer 14 to form a fluid and moisture tight seal therebetween. When the exterior wall section 12 includes a window 74, the layers of the exterior wall section 12 will each include (e.g., define) an opening aligned with the window, in order to accommodate the window. Specifically, as shown in FIG. 2, the structural layer 14, the sheathing layer 32, the moisture barrier 36, the insulation layer 16 and the siding 18 all define openings aligned with the window 74 (and with the other layers' openings).

In an exemplary method of assembling the exterior wall system 10 on the framework F of the building, a first exterior wall section 12 is connected to the framework with the mounting assembly 22. A second exterior wall section 12 is connected to the framework F adjacent to (e.g., directly above or below or to the left or right) the first exterior wall sections 12. More particularly, the structural layers 14 are connected directly to the framework F by the mounting assembly 22. When the second exterior wall section 12 is positioned on the framework F, the interlocking structures 44 of the first and second exterior wall sections mate with one another to form the seal between the first and second exterior wall sections. Specifically, the second exterior wall section 12 is moved toward the first exterior wall section until the male and female interlocking connectors 46, 48 mate with one another. In the exemplary embodiment, the first and second arms 50, 52 of the male interlocking connector 46 enter the channel 62 of the female interlocking connector 48 and engage and deflect the gaskets 64. In addition, if included, the weather strip 70 of either the first or second exterior wall section 12 engages the other exterior wall section (e.g., the perimeter 42 thereof) or a weather strip on the other exterior wall section. Once the interlocking structures 44 are mated, the seal between the first and second exterior wall sections 12 is formed. This process repeats until all the exterior wall sections 12 are attached to the framework F of the building B. Once the exterior wall system 10 is assembled, the portion of each interlocking structure 44 along each side edge margin of the perimeter 42 of one exterior wall section 12 mates with a corresponding portion of another exterior wall section, thereby forming a substantially continuous seal around each exterior wall section. Accordingly, when the exterior wall system 10 is assembled, interlocking structures 44 create a substantially gap-free exterior wall to inhibit the outside environment from flowing into the interior of the building, and vice versa. As a result, the overall time to construct an exterior wall for the building B is reduced, specifically over conventional exterior wall systems which require manually sealing or caulking between wall sections and/or the framework after the wall sections are attached to the framework.

FIGS. 2-6 are cross-section views of the exterior wall sections 12 of FIG. 1. For clarity and simplicity, only some of the components in these cross-sections are shown with cross-section hatching, indicating the cross-section plane intersected those components. It is understood that other components may have been intersected by the cross-section plane but are nevertheless shown without cross-section hatching. It is well within the capabilities of a person having ordinary skill in the art to determine what components without cross-section hatching are in fact intersected by the cross-section plane based on the provided figures and the description herein. For example, it is understood the sheathing 34 is intersected by the cross-section plane in each of FIGS. 2-6.

Modifications and variations of the disclosed embodiments are possible without departing from the scope of the invention defined in the appended claims.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. An exterior wall section for forming a portion of an exterior wall of a building, the building having multiple floors and a framework defining the multiple floors, the exterior wall section comprising:

a structural layer configured to be connected to the framework of the building and to support a weight of the exterior wall section, the structural layer including a plurality of studs connected together, the structural layer having an interior side configured to face an interior of the building and an opposite exterior side configured to face an exterior of the building, the exterior side disposed exteriorly of the interior side;

an insulation layer supported by the structural layer and including insulation configured to insulate the building from an outside environment, the insulation layer being disposed exteriorly of the structural layer;

a moisture barrier supported by the structural layer and disposed between the structural layer and the insulation layer;

siding supported by the structural layer and disposed exteriorly of the structural layer and insulation layer, the siding defining an exterior side of the exterior wall section, the entirety of the siding of the exterior wall section being supported by the structural layer;

a perimeter defined by edge margins of at least one of the structural layer, the insulation layer or the siding; and an interlocking structure extending along the perimeter and configured to fit together with a corresponding interlocking structure of at least one other exterior wall section to form a seal with said at least one other exterior wall section when the exterior wall sections are connected to the framework of the building.

2. The exterior wall section of claim 1, wherein the interlocking structure extends along a majority of the perimeter of the exterior wall section.

3. The exterior wall section of claim 2, wherein the interlocking structure extends along the entire perimeter of the exterior wall section.

4. The exterior wall section of claim 2, wherein the interlocking structure includes a first interlocking connector and a second interlocking connector, the first interlocking connector being configured to form a seal with a second interlocking connector of the at least one other exterior wall section to form a seal with said at least one other exterior wall section.

5. The exterior wall section of claim 4, wherein the perimeter includes opposite top and bottom segments, one of the first or second interlocking connectors extending along one of the top or bottom segments, the other of the first or second interlocking connectors extending along the other of the top or bottom segments.

6. The exterior wall section of claim 5, wherein the perimeter includes opposite left and right side segments, one of the first or second interlocking connectors extending along one of the left side segment or right side segment, the other of the first or second interlocking connectors extending along the other of the left side segment or right side segment.

7. The exterior wall section of claim 4, wherein the first interlocking connector is a male interlocking connector and wherein the second interlocking connector is a female interlocking connector, the male interlocking connector being configured to be inserted into a female interlocking connector of the at least one other exterior wall section and the female interlocking connector being configured to receive a male interlocking connector of the at least one other exterior wall section.

8. The exterior wall section of claim 7, wherein the male interlocking connector includes a first arm configured to engage the female interlocking connector of the at least one other exterior wall section to form at least a portion of the seal therebetween.

9. The exterior wall section of claim 8, wherein the male interlocking connector includes a second arm configured to engage the female interlocking connector of the at least one other exterior wall section to form at least a portion of the seal therebetween.

10. The exterior wall section of claim 9, wherein the first arm is disposed exteriorly of the second arm.

11. The exterior wall section of claim 9, wherein the female interlocking connector defines a channel extending along the perimeter of the exterior wall section, the channel of the female interlocking connector being configured to receive first and second arms of the male interlocking connector of the at least one other exterior wall section.

12. The exterior wall section of claim 11, wherein the female interlocking connector includes first and second gaskets configured to engage the first and second arms, respectively, of the male interlocking connector of the at least one other exterior wall section.

13. The exterior wall section of claim 12, wherein the first and second gaskets are disposed in the channel.

14. The exterior wall section of claim 12, wherein the interlocking structure comprises an extruded aluminum member.

15. The exterior wall section of claim 1, further comprising a weather strip extending along the perimeter and disposed exteriorly of the interlocking structure, the weather strip being configured to operatively engage a perimeter of the at least one other exterior wall section to inhibit a liquid from the outside environment from reaching the interlocking structure when the exterior wall sections are connected to the framework of the building.

16. The exterior wall section of claim 15, in combination with the at least one other exterior wall section.

17. The exterior wall section of claim 1, wherein the interlocking structure is secured to the structural layer.

18. The exterior wall section of claim 17, wherein the interlocking structure extends outward from the edge margins of the structural layer.

19. The exterior wall section of claim 1, further comprising a sheathing layer mounted on an exterior face of the structural layer, the sheathing layer including one or more sheets of sheathing.

20. The exterior wall section of claim 19, wherein each sheet of sheathing is made from a magnesium oxide based material.

21. The exterior wall section of claim 19, wherein the moisture barrier is mounted on an exterior side of the sheathing layer, the exterior side of the sheathing layer configured to face the exterior of the building.

22. The exterior wall section of claim 1, further comprising a window, the structural layer, the insulation layer, the moisture barrier and the siding each including an opening aligned with the window.

23. The exterior wall section of claim 1, wherein the exterior wall section has a height greater than a height of one floor of the building.

24. The exterior wall section of claim 1, wherein the structural layer, the insulation layer, the siding, and the interlocking structure are coupled together to form a selfcontained modular unit that is configured to be connected to the framework of the building.

25. The exterior wall section of claim 1, wherein the structural layer supports an entire weight of the insulation layer, an entire weight of the moisture barrier, an entire weight of the siding, and an entire weight of the interlocking structure.

26. The exterior wall section of claim 25, wherein the weight of the exterior wall section the structural layer supports is an entire weight of the exterior wall section.

27. The exterior wall section of claim 1, wherein the interlocking structure is arranged to be inserted into or receive the interlocking structure of said at least one other exterior wall section to form the seal with said at least one other exterior wall section upon placement of the exterior wall sections on the framework of the building.

28. The exterior wall section of claim 1, wherein the interlocking structure is fixed to the perimeter.

29. An exterior wall section for forming a portion of an exterior wall of a building, the building having multiple floors and a framework defining the multiple floors, the exterior wall section comprising:

a structural layer configured to be connected to the framework of the building and to support a weight of the exterior wall section, the structural layer including a header, a footer, exterior side studs extending between and connected to the header and the footer, and at least two intermediate studs disposed between and spaced apart from the exterior side studs, the at least two intermediate studs extending between and connected to the header and the footer;

an insulation layer supported by the structural layer and including insulation configured to insulate the building from an outside environment;

siding supported by the structural layer and disposed exteriorly of the structural layer and insulation layer, the siding defining an exterior side of the exterior wall section;

a perimeter defined by edge margins of at least one of the structural layer, the insulation layer or the siding; and an interlocking structure extending along the perimeter and configured to fit together with a corresponding interlocking structure of at least one other exterior wall section to form a seal with said at least one other exterior wall section when the exterior wall sections are connected to the framework of the building.

30. The exterior wall section of claim 1, wherein the insulation layer is a first insulation layer, the exterior wall section further comprising a second insulation layer supported by the structural layer and includes insulation configured to insulate the building from an outside environment, the second insulation layer being spaced apart from the first insulation layer.

* * * * *